US007643780B2

(12) United States Patent
Kweon

(10) Patent No.: US 7,643,780 B2
(45) Date of Patent: Jan. 5, 2010

(54) DEVELOPING CARTRIDGE AND IMAGE FORMING APPARATUS HAVING THE SAME

(75) Inventor: Dae-seob Kweon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 168 days.

(21) Appl. No.: 11/865,802

(22) Filed: Oct. 2, 2007

(65) Prior Publication Data

US 2008/0219710 A1 Sep. 11, 2008

(30) Foreign Application Priority Data

Mar. 9, 2007 (KR) ..... 10-2007-0023504

(51) Int. Cl.
*G03G 15/08* (2006.01)

(52) U.S. Cl. ..... 399/281; 399/272

(58) Field of Classification Search ..... 399/281, 399/272, 113, 119, 110
See application file for complete search history.

(56) References Cited

U.S. PATENT DOCUMENTS 4,989,037 A 1/1991 Nagatsuna
5,384,628 A 1/1995 Takami et al.
6,321,057 B1 11/2001 Yamamoto
7,283,761 B2 * 10/2007 Matsuda et al. ..... 399/281 X

FOREIGN PATENT DOCUMENTS

| | | |
|---|---|---|
| JP | 2001-235941 | 8/2001 |
| JP | 2001-265114 | 9/2001 |
| JP | 2005-242225 | 9/2005 |
| JP | 2007-248677 A * | 9/2007 |
| KR | 97-28912 | 6/1997 |
| KR | 1999-25955 | 7/1999 |

OTHER PUBLICATIONS

Machine translation of JP 2005-042225 A dated May 17, 2009.*
European Search Report dated Jun. 5, 2008 issued in EP 08100904.5.

* cited by examiner

*Primary Examiner*—Sophia S Chen
(74) *Attorney, Agent, or Firm*—Stanzonie & Kim LLP

(57) ABSTRACT

A developing cartridge usable with an image forming apparatus, the developing cartridge includes a supporting frame, a developing member which is supported in the supporting frame, and to supply the developer to an electrostatic latent image of a photosensitive body of the image forming apparatus, a supplying member which is supported in the supporting frame, and to supply the developer to the developing member, and an elastic unit which is supported in the supporting frame, and to elastically support the supplying member so that the supplying member can move toward and away from the developing member.

22 Claims, 4 Drawing Sheets

DEVELOPING CARTRIDGE AND IMAGE FORMING APPARATUS HAVING THE SAME

CROSS-REFERENCE TO RELATED APPLICATIONS

This application claims priority under 35 U.S.C. § 119 (a) from Korean Patent Application No. 10-2007-0023504, filed on Mar. 9, 2007 in the Korean Intellectual Property Office, the disclosure of which is incorporated herein in its entirety by reference.

BACKGROUND OF THE INVENTION

1. Field of the Invention

The present general inventive concept relates to a developing cartridge and an image forming apparatus having the same, and more particularly, to a developing cartridge having an improved supporting configuration of a supplying member to supply developer to a developing member and an image forming apparatus having the same.

2. Description of the Related Art

In general, an image forming apparatus forms an image signal received from a host apparatus on a printing medium as an image. For this purpose, a developing cartridge which stores developer is detachably mounted to the image forming apparatus. The developing cartridge comprises a photosensitive body to form an electrostatic latent image by a potential difference, a developing member to supply the developer to the electrostatic latent image, and a supplying member to supply developer to the developing member. The photosensitive body, the developing member and the supplying member are provided in a roller type to rotate facing each other, respectively.

In the image forming apparatus according to conventional technology, the supplying member rotates facing the developing member so that mutually facing areas therebetween can move in an opposite direction, and forms a nip of a predetermined interval therebetween. Accordingly, the supplying member supplies the developer onto a surface of the developing member, and resets a remaining electric potential of the developing member after supplying the developer onto the photosensitive body.

However, the conventional image forming apparatus has following problems. In general, the supplying member comprises urethane foam or silicon foam and stress on the developer is severely generated in an area forming a nip with the developing member. Due to the stress, an external additive of the developer drops out to result in a reversed polar developer, to thereby cause a background phenomenon or a ghost phenomenon, and to lower a reproducibility of a dot or a resolution of the image, and accordingly, an entire image quality formed on a printing medium is depreciated.

Meanwhile, so as to solve the problem, an image forming apparatus including a supplying member which is formed with a fur brush on its circumference has been proposed. Such image forming apparatus has an advantage to form a smaller nip between the developing member and the supplying member in comparison to where a supplying member in urethane foam or silicon foam is applied.

However, in the conventional image forming apparatus is deposited developer in the fur brush during the use, and the deposited developer is cured as long time passes after the driving of the apparatus. As a result, a layer of the cured developer suddenly increases torque in initial driving of the developing cartridge to cause a misalignment phenomenon, and at the same time, to cause the same problem where the supplying member in the urethane foam or the silicon foam is applied.

SUMMARY OF THE INVENTION

Accordingly, it is an aspect of the present general inventive concept to provide a developing cartridge capable of preventing a misalignment phenomenon caused by a sudden increase of a driving torque in initial driving of a developing cartridge such as due to a supplying member in a fur brush type and an image forming apparatus having the same.

The present general inventive concept is to provide a developing cartridge capable of reducing stress of developer generated in a nip between the developing member and the supplying member and an image forming apparatus having the same.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept can be also achieved by providing a developing cartridge usable with an image forming apparatus, the developing cartridge, comprising a supporting frame, a developing member which is supported in the supporting frame, and to supply the developer to an electrostatic latent image of a photosensitive body of the image forming apparatus, a supplying member which is supported in the supporting frame, and to supply the developer to the developing member, and an elastic unit which is supported in the supporting frame, and to elastically support the supplying member so that the supplying member can move toward and away from the developing member.

The elastic unit may restore the supplying member to an original position if an external force is removed after the supplying member is separated from the developing member according to the external force applied to the supplying member.

The elastic unit may comprise a shaft holder to support the supplying member, and an elastic member to elastically press the shaft holder toward the developing member.

The elastic unit may comprise a guide rail unit which is supported in the supporting frame and to guide movement of the shaft holder.

The guide rail unit may comprise a holder moving guide to guide the shaft holder to slide along with the supporting frame, and an elastic member accommodating portion which is formed in the supporting frame to be communicated with the holder moving guide, and to accommodate and support the elastic member so as to press the shaft holder.

The guide rail unit may comprise an access regulating portion which is provided in one end portion of the holder moving guide facing the developing member and to regulate the shaft holder to move in a direction pressing the elastic member, and a separation regulating portion which is provided in the other end portion of the holder moving guide opposite to the access regulating portion and to regulate movement of the shaft holder in an opposite direction with respect to the pressure direction of the elastic member.

A distance D in which the supplying member may move by the elastic unit satisfies the following formula 1, <formula 1> $0.4 \leqq D \leqq 0.6$ [mm].

The supporting member and the developing member may rotate so that portions thereof facing each other can move in an opposite direction.

The supplying member may comprise a supplying member main body, and a fur brush which is provided along with a radial direction of the supplying member from a circumference of the supplying member main body.

A thickness Ft and a length Fl of one texture of the fur brush may satisfy the following formula 2, <formula 2> $4 \leqq Ft \leqq 8$ [denier] $1.0 \leqq Fl \leqq 2.0$ [mm].

A nip N between the developing member and the supplying member may satisfy the following formula 3, <formula 3> $0.1 \leqq N \leqq 0.5$ [mm].

The foregoing and/or other aspects and utilities of the present general inventive concept can be also achieved by providing an image forming apparatus, comprising a photosensitive body, a laser scanning unit to scan a beam onto the photosensitive body and to form an electrostatic latent image, a developing cartridge to form a visible image by developer with respect to the electrostatic latent image formed on the photosensitive body and to transfer the image to a printing medium, the developing cartridge includes a supporting frame, a developing member to supply the developer to the photosensitive body, a supplying member to supply the developer to the developing member, and an elastic unit to elastically support the supplying member so that the supplying member can move toward and away from the developing member, and a fusing unit to fuse the image of the developer transferred to the printing medium.

The supplying member may include a supplying member main body, and a fur brush which is provided along in a radial direction of the supplying member from a circumference of the supplying member main body.

A thickness Ft and a length Fl of one texture of the fur brush may satisfy the following formula 4, <formula 4> $4 \leqq Ft \leqq 8$ [denier] $1.0 \leqq Fl \leqq 2.0$ [mm].

A nip N between the developing member and the supplying member may satisfy a following formula 5, <formula 5> $0.1 \leqq N \leqq 0.5$ [mm].

The foregoing and/or other aspects and utilities of the present general inventive concept can be also achieved by providing a developing cartridge usable with an image forming apparatus, the developing cartridge, comprising a supporting frame, a developing member which is supported in the supporting frame, and to supply the developer to an electrostatic latent image of a photosensitive body of the image forming apparatus, a supplying member which is supported in the supporting frame, and to supply the developer to the developing member, wherein the supplying member moves between a reference position adjacent to the developing member and a separation position separated from the developing member.

The supplying member may comprise a supplying member main body, and a fur brush which is provided along in a radial direction of the supplying member from a circumference of the supplying member main body.

The developing cartridge may comprising an elastic unit which is provided in the supporting frame, and to elastically support the supplying member so that the supplying member can move toward and away from the developing member.

The foregoing and/or other aspects and utilities of the present general inventive concept may also be achieved by providing a developing cartridge usable with an image forming apparatus, the developing cartridge including a developing member to supply developer to a photosensitive body of the image forming apparatus, and a supplying member to supply the developer to the developing member and to form a nip with the developing member, wherein the nip is regulated by changing a distance between the supplying member and the developing member.

The foregoing and/or other aspects and utilities of the present general inventive concept may also be achieved by providing an image forming apparatus, including a photosensitive body, and a developing cartridge including a developing member to supply developer to the photosensitive body, and a supplying member to supply the developer to the developing member and to form a nip with the developing member, wherein the nip is regulated by changing a distance between the supplying member and the developing member.

The foregoing and/or other aspects and utilities of the present general inventive concept may also be achieved by providing a developing cartridge usable with an image forming apparatus, comprising a casing having a supporting frame to contain a developer, a developing member, and a supply member to supply the developer to the developing member, and to move according to a thickness of the developer deposited on a fur unit thereof to adjust the thickness of the developer.

The foregoing and/or other aspects and utilities of the present general inventive concept may also be achieved by providing a developing cartridge usable with an image forming apparatus, comprising a developing member having a rotation axis, and a supply member to supply a developer to the developing member, and having a rotation axis to be movable with respect to the rotation axis of the developing member.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
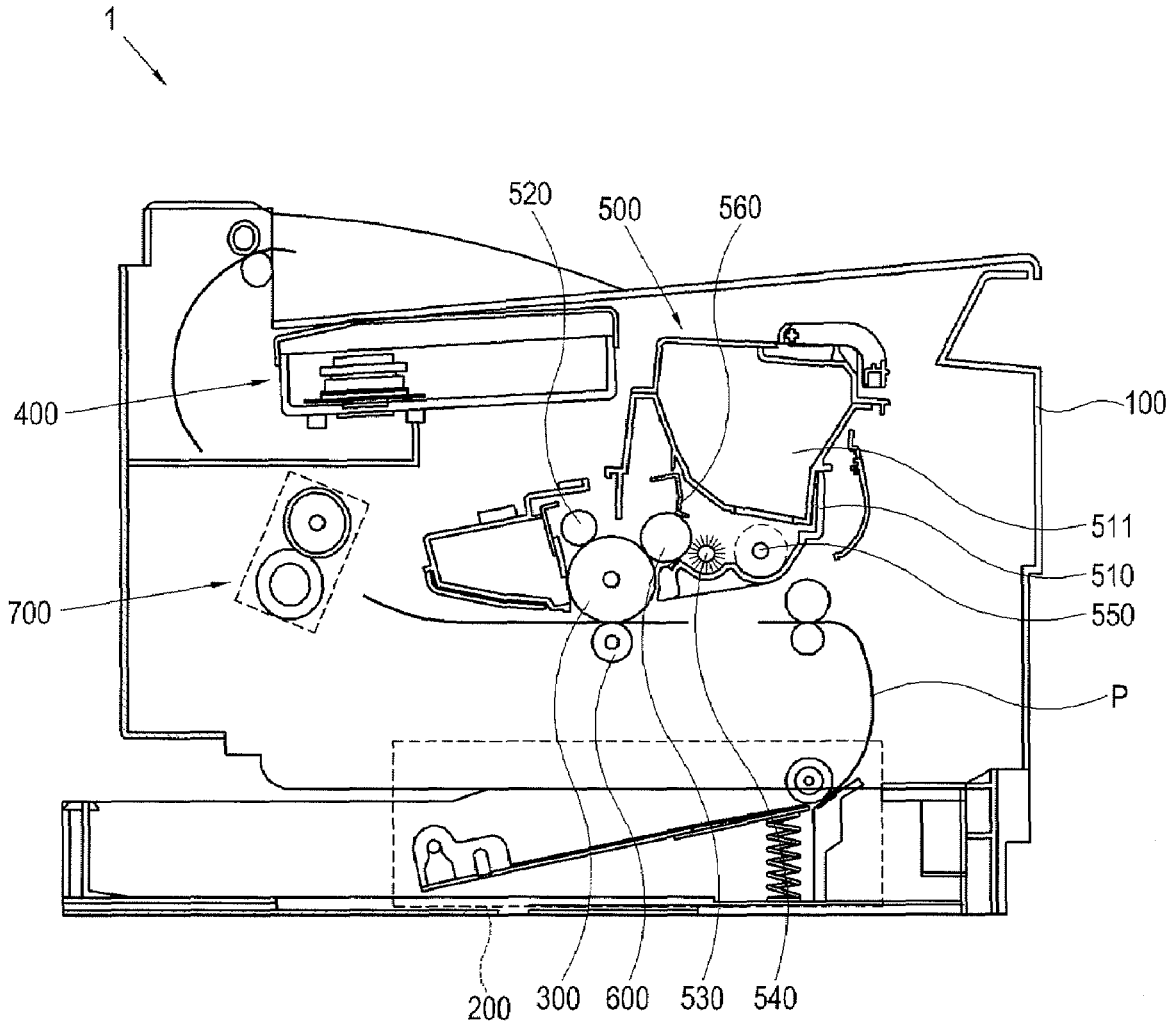
FIG. 1 is a side sectional view illustrating an image forming apparatus according to the present general inventive concept.

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

As illustrated in FIG. 1 to 4, the image forming apparatus 1 according to the present general inventive concept includes a main body casing 100 which accommodates various components of the apparatus, a printing medium supplying unit 200 to store a printing medium P is stored, a photosensitive body 300 to form an electrostatic latent image and a visible image by developer T, a light scanning unit 400 to form an electrostatic latent image on the photosensitive body 300 by a potential difference, a developing cartridge 500 to store the developer T and to supply the developer T to the electrostatic latent image of the photosensitive body 300, a transfer unit 600 to transfer the visible image on the photosensitive body 300 onto the printing medium P supplied from the printing medium supplying unit 200, and a fusing unit 700 to fuse the image on the printing medium P.

The developer T can be classified into a binary ingredient type, a mono magnetic ingredient type, and a mono non-magnetic ingredient type according to a developing type of the image forming apparatus 1. In the developer T in the mono non-magnetic ingredient type, resin to regulate an amount of a reference electric charge and functions as a main factor to determine a fusing temperature takes over a share of 90% of the entire ingredients. In addition, carbon to determine polarity and color, an electrifying additive charge control agent (CCA), an additional additive wax for fluidity and silica for hydrophobic property and fluidity are added. The developer T has the fluidity in a dry state due to the above ingredients, and at the same time, is electrified to a predetermined electric potential value by a frictional force.

The main body casing 100 forms an appearance of the image forming apparatus 1, and accommodates and supports the components to form the image forming apparatus 1 in an accommodating space formed in its inside. One side of the main body casing 100 is provided to open and close in order to replace the developing cartridge 500.

The photosensitive body 300 is provided in a shape of a cylindrical drum which is extended in a predetermined length to correspond to a width of the printing medium P. The photosensitive body 300 is charged to a uniform polar electric potential by an electrifying member 520 to be described later. On the photosensitive body 300 of which the circumference is uniformly charged is formed an electrostatic latent image by a potential difference from a beam scanned from the light scanning unit 400. The developer T is supplied to the electrostatic latent image by a developing member 530 to be described later, and the visible image formed by the developer T is transferred onto the printing medium P passing through the photosensitive body 300 and the transfer unit 600.

The photosensitive body 300 coupled to the developing cartridge 500 is replaced in company with the developing cartridge 500 that used up the developer T. However, the photosensitive body 300 may be provided to be detached with respect to the main body casing 100 separately from the developing cartridge 500 considering that durability of the photosensitive body 300 is generally longer in comparison with a consumption time of the developer T stored in the developing cartridge 500. The photosensitive body 300 is coupled to the developing cartridge 500 in an exemplary embodiment of the present general inventive concept, but it is not limited thereto.

The light scanning unit 400 scans a beam corresponding to image data to be formed on the printing medium P onto the photosensitive body 300. If the beam is scanned from the light scanning unit 400 onto a circumference of the photosensitive body 300 which is uniformly electrified, there is generated a potential difference between an area in which the beam is scanned and an area in which the beam is not scanned, and accordingly, on the circumference of the photosensitive body 300 is formed an electrostatic latent image. The light scanning unit 400 may comprise a laser scanning unit (LSU) using a laser diode as a light source, but not limited thereto.

The developing cartridge 500 stores the developer T, and supplies the developer T to the photosensitive body 300, to thereby form a visible image on the photosensitive body 300 by the developer T. The developing cartridge 500 is detachably provided with respect to the main body casing 100 so as to be replaced with a new developing cartridge 500 if the stored developer T is used up. Also, the developing cartridge 500 may be integrated with the photosensitive body 300 as in an exemplary embodiment of the present general inventive concept, and may be provided separately from the photosensitive body 300, as necessary.

If the developing cartridge 500 is completely mounted to the main body casing 100, a driving force formed in a predetermined driving unit (not illustrated) provided in the main body casing 100 is transmitted to the developing cartridge 500. Accordingly, the photosensitive body 300 and components such as the developing member 530 and a supplying member 540, which will be described later, included in the developing cartridge 500 are rotationally driven.

The developing cartridge 500 comprises a cartridge casing 510 to accommodate the photosensitive body 300 and various components of the developing cartridge 500, an electrifying member 520 to uniformly charge the circumference of the photosensitive body 300, the developing member 530 to supply developer T to the electrostatic latent image formed on the photosensitive body 300, the supplying member 540 to supply the developer T to the developing member 530, a stirrer 550 to stir the developer T stored in the developing cartridge 500, a regulating blade 560 to contact an area of the developing member 530, a leak preventing member 570 to contact another area of the developing member 530, and an elastic unit 580 to move the supplying member 540 toward and away from the developing member 530. That is, to move the supplying member 540 to elastically approach and separate with respect to the developing member 530.

Here, a configuration of the electrifying member 520, the developing member 530, and the supplying member 540 is not limited thereto, but it may comprise a roller type and be arranged such that the electrifying member 520, the developing member 530, and the supplying member 540 are in parallel with the photosensitive body 300 to rotate. The configuration of the members will be further described in accordance with the roller type in an exemplary embodiment of the present general inventive concept.

The cartridge casing 510 accommodates and supports the various components of the developing cartridge 500, and comprises a developer storing unit 511 to store the developer T therein. The cartridge casing 510 is opened in one area on a feeding path of the printing medium P where the photosensitive body 300 contacts the transfer unit 600 to transfer the visible image formed in the photosensitive body 300 to the printing medium P. Also, the cartridge casing 510 is opened in an other area to face the light scanning unit 400 to allow the beam scanned from the light scanning unit 400 to reach the photosensitive body 300.

Figure 3:
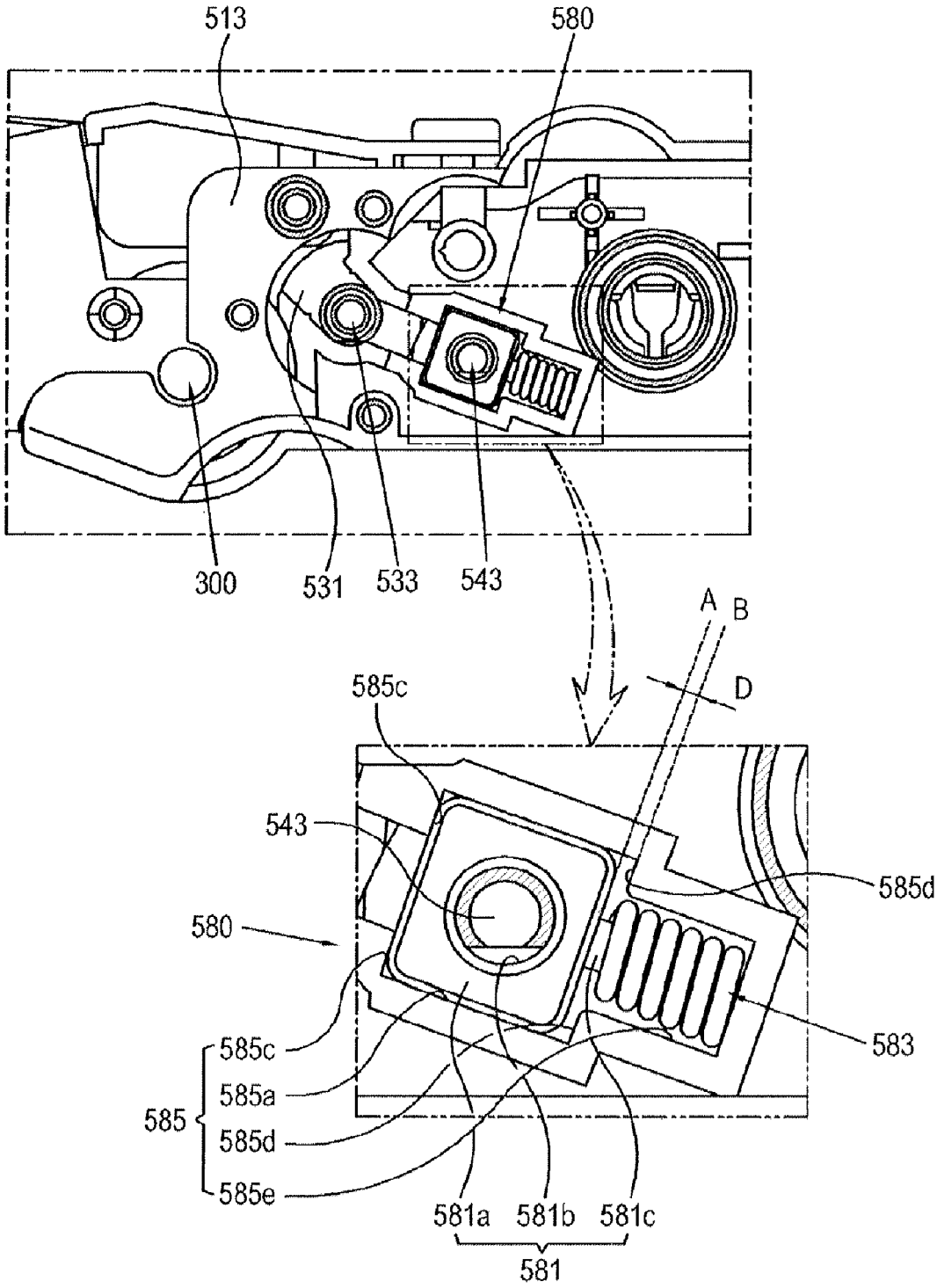
FIG. 3 is a side sectional view illustrating end portion areas of a developing member and a supplying member in the developing cartridge in FIG. 2.
Figure 4:
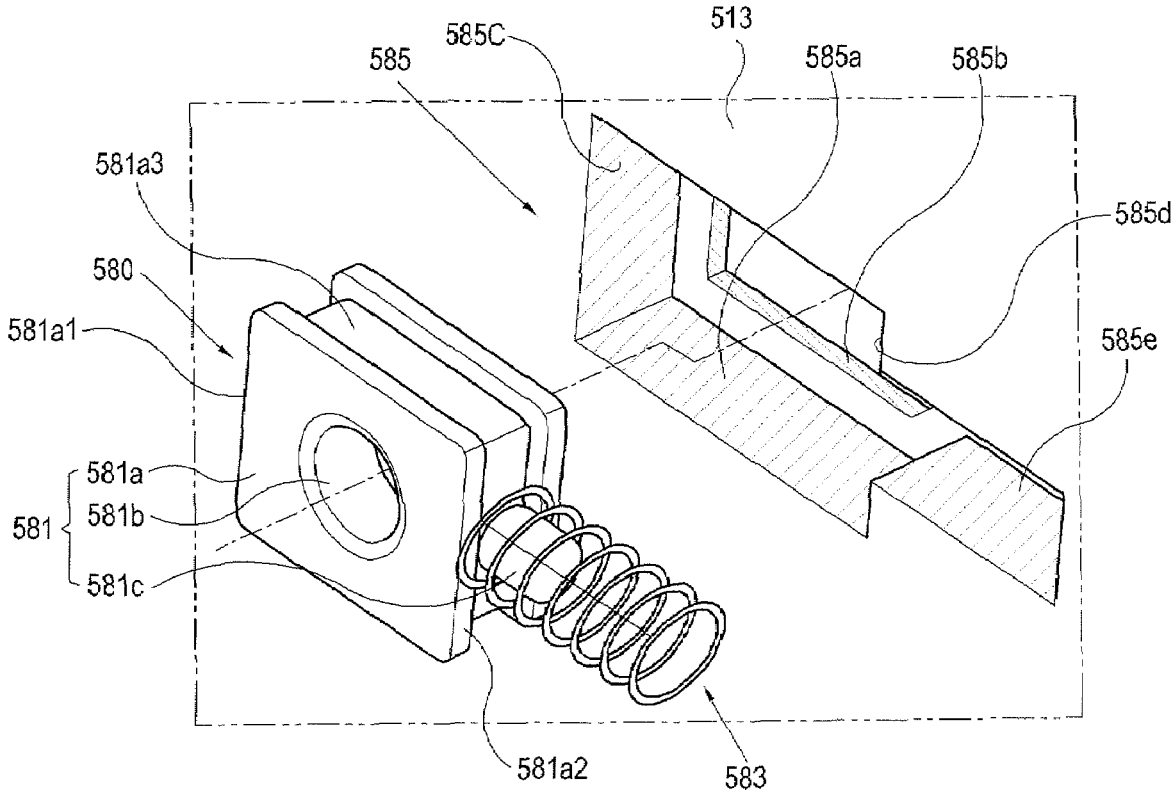
FIG. 4 is a perspective view illustrating an elastic unit in the developing cartridge in FIG. 3.

The cartridge casing 510 detachably mounted to the main body casing 100 is installed with the photosensitive body 300, the developing member 530 and the supplying member 540 so that their lengthwise direction can be parallel with a detaching direction of the cartridge casing 510. As illustrated in FIGS. 3 and 4, the cartridge casing 510 includes a supporting frame 513 which is provided in opposite end portions of the photosensitive body 300, the developing member 530 and the supplying member 540.

The developer storing unit 511 stores the developer T supplied to the photosensitive body 300. The developer storing unit 511 is opened in one area adjacent to the developing member 530 for the stored developer T to be transmitted to the developing member 530 by the stirrer 550 and the supplying member 540.

The supporting frame 513 is provided in a planar shape having a predetermined thickness and is extended perpendicularly with respect to a lengthwise direction of the photosensitive body 300, the developing member 530 and the supplying member 540. Accordingly, the supporting frame 513 supports the photosensitive body 300, the stirrer 550, the developing member 530 and the supplying member 540 to rotate. Here, the supporting frame 513 is provided as a pair of frame portions mutually facing opposite sides of the developing cartridge 500 supports each of the end portions of the photosensitive body 300, the developing member 530 and the supplying member 540 to be rotated.

Figure 2:
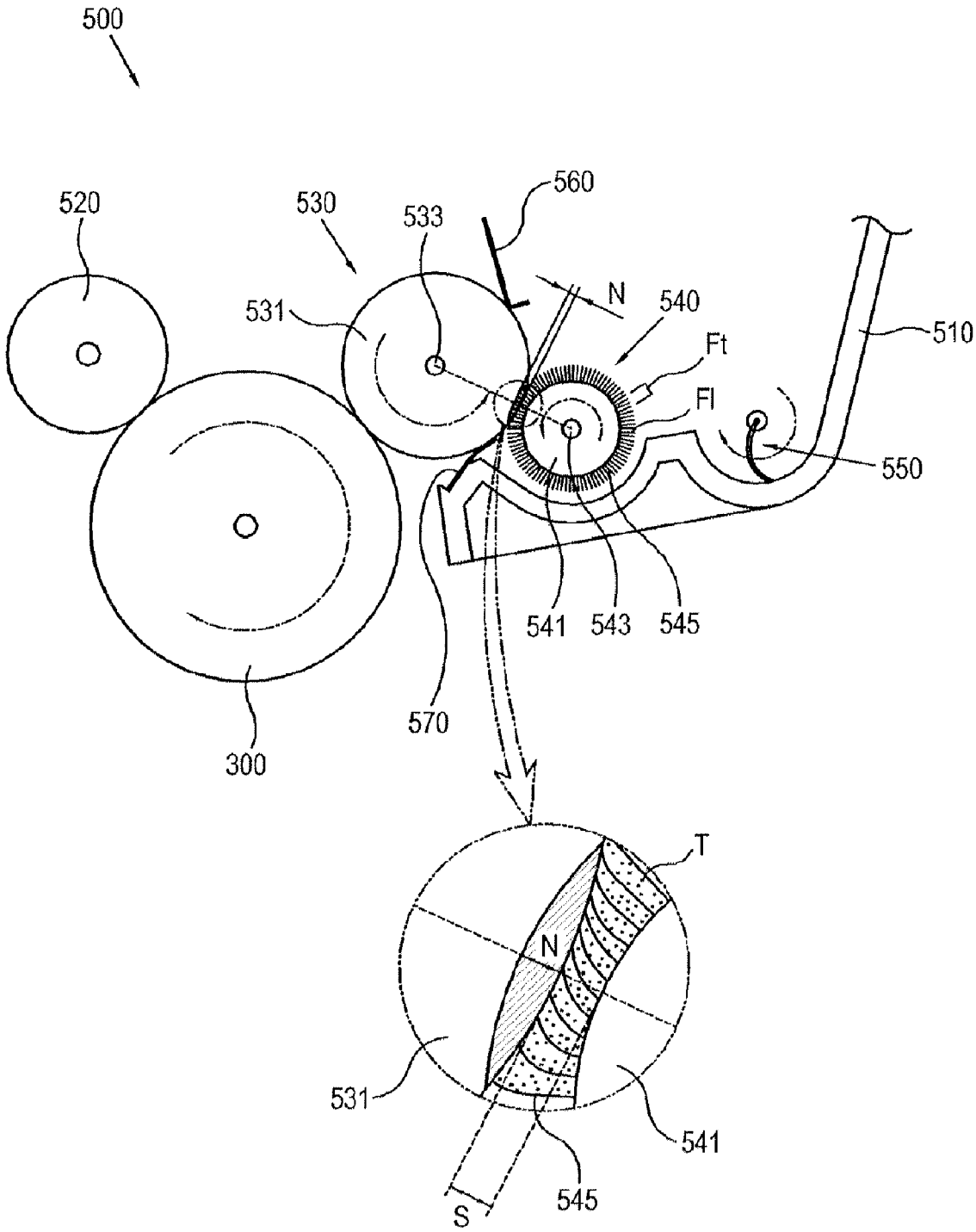
FIG. 2 is a side sectional view illustrating a main portion of a developing cartridge in the image forming apparatus in FIG. 1.

Referring to FIGS. 1 and 2, the electrifying member 520 is provided inside of the cartridge casing 510 and rotates to contact the photosensitive body 300. The electrifying member 520 is supplied with a charging bias to charge the circumference of the photosensitive body 300 to a same electric potential value. If the beam is scanned from the light scanning unit 400 onto the photosensitive body 300 charged in the uniform electric potential value, the electric potential value changes in a position where the beam is scanned by a light conductive characteristic of the photosensitive body 300. Accordingly, on the photosensitive body 300 is formed an electrostatic latent image by a potential difference.

The developing member 530 is installed adjacent to the developer storing unit 511 to rotate in an opposite direction with respect to a rotational direction of the photosensitive body 300, that is, so that mutually facing portions of the photosensitive body 300 and the developing member 530 can move in a same direction. The developing member 530 applied with the developing bias rotates in contact with the supplying member 540, and the developer T from the supplying member 540 is adhered to by the potential difference from the supplying member 540. The developing member 530 adhered to with the developer T on its circumference, rotates in contact with the photosensitive body 300 and supplies the developer T to the electrostatic latent image of the photosensitive body 300.

The developing member 530 comprises a developing member main body 531 of a cylindrical shape, and a developing member shaft 533 which is rotationally supported in the supporting frame 513 to rotate the developing member main body 531 to rotate. The developing member main body 531 is adhered to with the developer T on its outer circumference surface and supplies the developer T to the photosensitive body 300. Meanwhile, the developing member shaft 533 is provided in a rotational center of the developing member main body 531, and rotates with a connected separate driving unit (not illustrated) provided in the main body casing 100, thereby rotating the developing member main body 531.

The supplying member 540 provided in the developer storing unit 511 rotates in contact with the developing member 530. The supplying member 540 supplies the developer T transferred by the stirrer 550 to the developing member 530. The supplying member 540 rotates in a same direction as the developing member 530. That is, the supplying member 540 and the developing member 530 rotate so that the portions thereof facing each other can move in an opposite direction. Accordingly, the developer T which passes through the supplying member 540 and the developing member 530 to receive a friction force is charged to the predetermined electric potential value and at a same time, a proper amount of developer T is adhered to the developing member 530.

The supplying member 540 forms a nip N in a predetermined area of its circumference contacted with the developing member 530 in the case that the supplying member 540 transfers the developer T to the developing member 530. The supplying member 540 refreshes or resets a surface of the developing member 530 by the nip N, and can supply the proper amount of developer T to the developing member 530.

If the nip N is preset large between the supplying member 540 and the developing member 530, the developer T receives excessive stress in an area of the nip N by a frictional force between the supplying member 540 and the developing member 530 moving in opposite direction to each other (or rotating in same direction). Accordingly, a reversed polar developer T is generated to cause an inferior image such as a background phenomenon, and torque of the supplying member 540 increases. Alternatively, if the nip N is preset small, the developer T is not smoothly transmitted to the developing member 530, and at the same time, a reset function of a remaining electric potential with respect to the surface of the developing member 530 is degraded. Accordingly, it is important that the supplying member 540 can supply the developer T to the developing member 530 and reset the developing member 530 while reducing the stress with respect to the developer T.

Accordingly, the supplying member 540 comprises a supplying member main body 541, a supplying member shaft 543 to rotate the supplying member main body 541, and a fur brush 545 which is provided on a circumference of the supplying member main body 541.

The supplying member main body 541 has a cylindrical shape extended along the lengthwise direction of the developing member 530. The supplying member main body 541 includes a steel use stainless (SUS) material. The supplying member main body 541 in which a rotational center of the supplying member shaft 543 passes therein rotates along with the rotation of the supplying member shaft 543.

The supplying member shaft 543 is provided in a rotational center of the supplying member main body 541 to be rotationally supported in the supporting frame 513. The end portion of the supplying member shaft 543 passes through the supporting frame 513 to be supported by a shaft holder 581 to be described later. The supplying member shaft 543 moves according to a movement of the shaft holder 581, and accordingly, an interval of the nip N between the supplying member and the developing member 530 is regulated.

The fur brush 545 includes a plurality of textures having nylon or acrylic materials on a circumference of the supplying member main body 541. An upper end portion of a plurality of textures of the fur brush 545 forms the nip N of a predetermined interval in a most adjacent area S between the developing member main body 531 and the supplying member main body 541 with respect to the supplying member main body 541. That is, the developing member main body 531 and the supplying member main body 541 do not contact each other, but the fur brush 545 forms the nip N through contacting with the developing member main body 531, and accordingly, the supply of the developer T to the developing member 530 and the reset of a remaining electric potential in the developing member 530 can be performed in an area of the nip N. Accordingly, the fur brush 545 can reduce the stress applied to the developer T in the area of the nip N, and can satisfy the supplying member 540, at the same time. The size of the nip N is the length to be deducted, that is, the length remaining after the distance of most adjacent area S is subtracted from the length of the fur brush 545.

A thickness Ft and a length Fl of one texture of the fur brush 545 satisfy the following formula 1.

$$4 \leqq Ft \leqq 8 \text{ [denier]}$$

$$1.0 \leqq Fl \leqq 2.0 \text{ [mm]} \qquad \text{[Formula 1]}$$

Here, the 1 denier denotes the thickness of the fur brush 545 with a length and mass of 450 [m] and 0.05 [g], respectively. If the thickness of one texture of the fur brush 545 is less than 4 [denier], it is difficult to manufacture the fur brush 545 and to improve an electrifying characteristic of the developer T since the texture is so soft. Alternatively, if the thickness of one texture of the fur brush 545 is over 8 [denier], the texture of the fur brush 545 is so stiff that the developer T is severely deposited and cured among the textures, and accordingly, the developer T is applied with excessive stress.

Meanwhile, if the length of one texture of the fur brush 545 is less than 1.0 [mm], the developer T can not permeate among the textures of the fur brush 545, and as a result, the developer T is not smoothly supplied to the developing member 530. Alternatively, if the length of one texture of the fur brush 545 is more than 2.0 [mm], fluidity of the developer T between the supplying member 540 and the developing member 530 is interfered with, thereby degrading an image spot.

The fur brush 545 transfers the developer T adhered to the fur brush 545 to the developing member 530 if its upper end portion passes through the nip N area and rotates. At this time, the developer T is repeatedly permeated and separated according to the rotation of the supplying member shaft 543 from a lower end portion of the fur brush 545 on the circumference of the supplying member main body 541. If the image forming apparatus 1 stops operating and the supplying member shaft 543 stops rotating, some of the developer T is deposited in the lower end portion. If time passes by in the deposited state, the deposited developer T is cured. The cured developer T may momentarily cause a misalignment phenomenon by blocking at an initial time when the supplying member shaft 543 resumes rotating, which will be described in detail later.

Here, a size N of the nip N formed between the supplying member 540 and the developing member 530 including the fur brush 545 satisfies the following formula 2.

$$0.1 \leqq N \leqq 0.5 \text{ [mm]} \qquad \text{[formula 2]}$$

Here, if the size N is less than 0.1 [mm], the supply of the developer T and the reset function with respect to a remaining electric potential of the developing member 530 can not be smoothly performed. If the size N is over 0.5 [mm], the fur brush 545 applies an excessive pressure to the circumference of the developing member 530 to result in separation of the developer T adhered to the developing member 530 or damage to the developing member 530. Here, the size N of the nip N may represent a distance in a radial direction of the developing member main body 531, or a transfer direction of the developer T.

The stirrer 550 is disposed in the lower side of the developer storing unit 511. The stirrer 511 stirs the developer T to prevent a solidification of the developer T and to improve fluidity of the developer T, and at the same time, enables the developer T to be charged to a predetermined electric potential value. The stirrer 511 moves the developer T to the supplying member 540, and enables the developer T to be transferred to the developing member 530. In an exemplary embodiment, a plurality of stirrers are disposed in the lower side of the developer storing unit 511.

The regulating blade 560 is contacted with the developing member 530 by a predetermined pressure. Accordingly, the regulating blade 560 secures uniformity of an amount of the developer T which is supplied from the supplying member 540 and adhered to the developing member 530, that is, the uniformity of the mass M/A g/cm$^2$ of the developer T per unit area of the developing member 530. Also, the regulating blade 560 charges the developer T adhered to the developing member 530 to a predetermined electric potential value. For this purpose, the regulating blade 560 may comprise a conductive material, and be supplied with power to have a uniform electric potential value.

The leak preventing member 570 shields a gap between the developer storing unit 511 and the developing member 530 so that the developer T can not be leaked through the gap. The leak preventing member 570 is provided to be adjacent to the developing member 530 from one area of the developer storing unit 511. Here, the leak preventing member 570 may be extended along the rotational direction of the developing member 530 so as to minimize an interference from the rotation of the developing member 530.

The elastic unit 580 provided in the supporting frame 513 enables the supplying member shaft 543 to elastically approach and separate with respect to the developing member 530. Accordingly, the elastic unit 580 changes the size of the nip N of the supplying member 540 and the developing member 530, more particularly, the size of the nip N which the fur brush 545 and the developing member main body 531 form. Here, the elastic unit 580 elastically separates the supplying member 540 from the developing member 530 by an external force generated in the nip N area, and returns the supplying member 540 to an original position to maintain an original interval of the nip N if the external force is removed.

Hereinafter, the misalignment phenomenon and the external force by the above-described blocking will be described in detail. If the fur brush 545 forms the nip N satisfying formula 2, the developing member main body 531 and the supplying member main body 541 rotating in the same direction have the most adjacent area S having the most adjacent distance in the area of the nip N. The developer T permeates through the texture of the fur brush 545 along with the rotating supplying member 540. The developer T is deposited in the lower end portion of the fur brush 545, that is, on the circumference of the supplying member main body 541, and the developer T is repeatedly deposited and separated according to the rotation of the supplying member 540.

However, as the image forming apparatus 1 stops operating and the unused period passes, the developer T deposited in the fur brush 545 is cured. At this time, since the fur brush 545 forms the nip N with the developing member main body 531, the layer of the cured developer T becomes thicker than the interval of the most adjacent area S. Accordingly, when the image forming apparatus 1 resumes operating, and the developing member 530 and the supplying member 540 starts to rotate, a blocking phenomenon that the cured developer T can not pass through the most adjacent area S is generated initially. The blocking phenomenon suddenly increases the initial driving torque of the developing cartridge 500, and causes the misalignment phenomenon that the driving unit (not illustrated) to rotate the developing member 530 and the supplying member 540 separates from the original position or breaks down.

The elastic unit 580 operates as follows. When the layer of the deposited and cured developer T among the fur brush 545 passes through the most adjacent area S in an initial driving of the developing cartridge 500, the layer of the developer T forms an external force pressing the supplying member 541 toward the rotational center of the supplying member 540.

The elastic unit 580 moves the supplying member shaft 543 in an opposite direction with respect to the developing member 530 by the external force, and accordingly, the interval of the nip N becomes smaller and the interval of the most adjacent area S becomes larger.

Further, the layer of the developer T easily passes through the most adjacent area S, and separates from the supplying member 540 as the supplying member 540 continually rotates. If the layer of the developer T separates from the supplying member 540, the external force operating on the elastic unit 580 is removed, and accordingly, the elastic unit 580 elastically returns the supplying member shaft 543 to the original position. Further, the interval of the nip N and the most adjacent area S is restored to the original state.

If the elastic unit 580 presets a position satisfying the above formula 2 as a reference, a distance where the supplying member 540 is separated from the reference, that is, a distance D that the supplying member 540 can move by the elastic unit 580 satisfies the following formula 3.

$$0.4 \leqq D \leqq 0.6 \text{ [mm]} \quad \text{[formula 3]}$$

Here, if the D is less than 0.4 [mm], the layer of the developer T has a difficulty in passing through the most adjacent area S in initially driving of the developing cartridge 500. Alternatively, if the D is greater than 0.6 [mm], the supplying member shaft 543 is likely to separate away from an error limit range of a position receiving a driving force from a predetermined driving unit (not illustrated).

The elastic unit 580 may be provided as a pair in opposite end portions in a lengthwise direction of the supplying member 540 so as to stably move the developing member 530 and the supplying member 540.

Referring to FIGS. 3 and 4, the elastic unit 580 comprises the following components so as to perform the above-described operations. The elastic unit 580 comprises a shaft holder 581 to support an end portion of the supplying member shaft 543 to rotate, an elastic member 583 to elastically press the shaft holder 581 toward the supplying member shaft 543, and a guide rail unit 585 which is provided in the supporting frame 513 and accommodates the shaft holder 581 and the elastic member 583 to guide movement of the shaft holder 581.

The shaft holder 581 comprises a holder main body 581*a* which has a rectangular plate shape and is accommodated in the guide rail unit 585 to move, a shaft accommodating portion 581*b* which is formed with a hole through the holder main body 581*a*, and an elastic member supporting portion 581*c* which is formed on a side of the holder main body 581*a*.

The holder main body 581*a* comprises a holder leading edge portion 581*a*1 which is formed on an edge of the plate in a side facing the developing member 530, a holder trailing edge portion 581*a*2 which is formed on an edge of the plate in an opposite side of the holder leading edge portion 581*a*1, and a cut-out portion 581*a*3 which is cut-out formed in an edge section of the holder main body 581*a* contacting with the guide rail unit 585.

The holder leading edge portion 581*a*1 is contacted with an access regulating portion 585*c* to be described later, and accordingly, the shaft holder 581 is regulated to move toward the developing member 530 by the pressure of the elastic member 583. Accordingly, the nip N between the developing member 530 and the supplying member 540 satisfies the above formula 2.

The holder trailing edge portion 581*a*2 is contacted with a separation regulating portion 585*d* to be described later, and accordingly, the shaft holder 581 is regulated to move in an opposite direction with respect to an elastic pressure direction of the elastic member 583. The holder trailing edge portion 581*a*2 prevents the supplying member 540 from being excessively separated from the developing member 530 by the layer of the developer T passing through the most adjacent area S. For example, if a predetermined driving unit (not illustrated) provided in the main body casing 100 transmits a driving force to the supplying member shaft 543, the supplying member shaft 543 may separate from the driving unit (not illustrated) to the position where the driving force can not be transmitted. The holder trailing edge portion 581*a*2 prevents such an occurrence by regulating the movement of the shaft holder 581.

The cut-out portion 581*a*3 is formed by cutting out the side section of the holder main body 581*a* contacting the guide rail unit 585. Accordingly, the frictional force generated between the holder main body 581*a* and the guide rail unit 585 is reduced while the holder main body 581*a* moves, thereby enabling the holder main body 581*a* to easily move. The guide rail unit 585 may have a rail formed on the supporting frame 513 to correspond to the cut-out portion 581*a*3 to guide the holder main body 581*a* to move in a radial direction of the supplying member shaft 543.

The shaft accommodating portion 581*b* is formed with the hole at a center portion of the holder main body 581*a*. The shaft accommodating portion 581*b* through which the supplying member shaft 543 passed is provided so as not to interfere the rotation of the supplying member shaft 543 by corresponding with the circumference of the supplying member shaft 543.

The elastic member supporting portion 581*c* is provided on an edge of the holder main body 581*a* facing the elastic member 583 to enable one end portion of the elastic member 583 to support the holder main body 581*a*. Accordingly, the elastic member 583 can elastically press the shaft holder 581 with ease.

The elastic member 583 is accommodated in an elastic member accommodating portion 585*e* (to be described later) to elastically press the shaft holder 581 toward the developing member 530. The elastic member 583 has been described as a coil spring in an exemplary embodiment of the present general inventive concept, but the configuration of the elastic member 583 to achieve the aim of the present general inventive concept is not limited thereto. For example, the elastic member 583 may include a planar spring.

One end portion of the elastic member 583 is supported in the elastic member supporting portion 581*c*, and an opposite end portion of the of the elastic member 583 is supported in one area of the elastic member accommodating portion 585*e* positioned in an opposite direction of the elastic member supporting portion 581*c*. Accordingly, the elastic member 583 elastically presses the shaft holder 581 in a stable manner.

The elastic force of the elastic member 583 is restored by an external force from the layer of the developer T. i.e., a pressure on the supplying member main body 541 if the layer of the developer T deposited and cured in the fur brush 545 passes through the most adjacent area S. The external force restores the elastic force of the elastic member 583 to press the elastic member 583 in an opposite direction with respect to the elastic press direction of the elastic member 583. Accordingly, the shaft holder 581 moves to a moving position in a direction in which the external force operates. If the external force is removed, the elastic member 583 restores the elastic force to return the shaft holder 581 to an original position. Thus, the shaft holder 581 is in the original position according to the elastic force of the elastic member 583, and in the moving position according to the external force generated from the developer T.

The guide rail unit 585 is provided in the supporting frame 513 vertical with respect to a lengthwise direction of the developing member 530 and the supplying member 540, that is, along with the planar surface of the supporting frame 513. The guide rail unit 585 accommodates the shaft holder 581 and the elastic member 583, and at the same time, guides the movement of the shaft holder 581.

To guide the movement of the shaft holder 581, the guide rail unit 585 comprises a holder moving guide 585*a* to guide the movement of the shaft holder 581, a shaft moving hole 585*b* which is a hole formed through the holder moving guide 585*a*, the access regulating portion 585*c* which is provided in one area of the holder moving guide 585*a*, the separation regulating portion 585*d* which is provided in another area of the holder moving guide 585*a*, and the elastic member accommodating portion 585*e* which is communicated with the holder moving guide 585*a* and accommodates the elastic member 583.

Referring to FIG. 3, a reference position A and a separation position B are defined. The reference position A denotes the position of the shaft holder 581 which enables the nip N to satisfy the formula 2. The separation position B denotes a position where the shaft holder 581 has moved in an opposite direction with respect to the elastic press direction of the elastic member 583 from the reference position A so that the layer of the developer T deposited and cured in the fur brush 545 can pass through the most adjacent area S. Since the moving distance of the supplying member 540 is the same as that of the shaft holder 581, the interval between the reference position A and the separation position B satisfies the above formula 3. Here, the reference position A may be the original position, and the separation position B may be the moving position.

The holder moving guide 585*a* is caved in from the planar surface of the supporting frame 513 to accommodate the shaft holder 581. The holder moving guide 585*a* is formed along with an imaginary straight line connecting the rotational centers of the developing member 530 and the supplying member 540, and guides movement of the accommodated shaft holder 581.

The shaft moving hole 585*b* is formed in the holder moving guide 585*a* so that the supplying member shaft 543 can pass through. The shaft moving hole 585*b* has enough size or shape for the supplying member shaft 543 to move along with the movement of the shaft holder 581. That is, the supporting frame 513 is prevented from interfering with the movement of the supplying member shaft 543 by the shaft moving hole 585*b*.

The access regulating portion 585*c* is formed in the holder moving guide 585 of the side directing the developing member 530, that is, in one end portion of the elastic member 583 that an elastic press is directed. The access regulating portion 585*c* regulates the holder leading edge portion 581*a* so that the shaft holder 581 pressed by the elastic member 583 can not move further from the reference position A toward the developing member 530 and maintain the reference position A.

The separation regulating portion 585*d* is formed at one end portion of the holder moving guide 585*a* directed opposite to the access regulating portion 585*c*, that is, between the holder moving guide 585*a* and the elastic member accommodating portion 585*e*. The separation regulating portion 585*d* regulates the holder trailing edge 581*a*2 to prevent the shaft holder 581 from moving further the separation position B by the external force produced when the layer of the developer T passes through the most adjacent area S. That is, the separation position denotes the position of the shaft holder 581 at a time when the holder trailing edge 581*a*2 is regulated by the separation regulating portion 585*d*.

The elastic member accommodating portion 585*e* is formed in the supporting frame 513 to be communicated with the holder moving guide 585*a*. The elastic member accommodating portion 585*e* accommodates the elastic member 583 and provides space in which the elastic member 583 elastically presses the shaft holder 581. The developing member 530 has a rotation axis, and the supplying member 549 has a rotation axis movable with respect to the rotational axis of the developing member 530 according to the elastic force of the elastic member 583 and a force of a thickness of the developer disposed between the developing member 530 and the supplying member 540.

An operation of the image forming apparatus 1 with this configuration according to the present general inventive concept will be described by referring to FIGS. 1 to 4.

If predetermined image data is transmitted to the image forming apparatus 1, the image forming apparatus 1 starts operating so as to form the image data on the printing medium P as an image. One printing medium out of a plurality of printing media stored in the printing medium supplying unit 200 is supplied to the photosensitive body 300.

The electrifying member 520 electrifies a circumference of the rotating photosensitive body 300 to a uniform electric potential value. The light scanning unit 400 scans a beam with respect to the circumference of the electrified photosensitive body 300 on a basis of the information of the image data. Accordingly, on the circumference of the photosensitive body 300 is formed an electrostatic latent image by a potential difference. The developing member 530 supplies the developer T to the electrostatic latent image, thereby forming a visible image on the photosensitive body 300.

In an initial state in which the image forming apparatus 1 stops operating, the supplying member 540 is positioned in the reference position A. At this time, the developer T forms the layer of the deposited and cured developer T along with the fur brush 545 from the circumference of the supplying member main body 541.

If the layer of the developer T is thicker than the interval of the most adjacent area S, the external force is generated by the layer of the developer T in the most adjacent area S if the supplying member 540 restarts rotating. The external force operates in a direction separating the supplying member 540 from the developing member 530, and restores the elastic pressure of the elastic member 583. The shaft holder 581 in the reference position A moves to the separation position B by the external force, and accordingly, the interval of the most adjacent area S becomes larger so that the layer of the developer T can easily pass through the most adjacent area S.

Although the external force is continually operated to the shaft holder 581 in the separation position B, the shaft holder 581 does not move in excess of the separation position B since the holder trailing edge portion 581*a*2 is in a state regulated by the separation regulating portion 585*d*.

Accordingly, as the supplying member 540 continues rotating after the layer of the developer T passes through the most adjacent area S, the layer of the deposited and cured developer T in the fur brush 545 is separated from the fur brush 545 and the supplying main body 541. Accordingly, the external force restoring the elastic pressure of the elastic member 583 is removed, and the elastic member 583 moves the shaft holder 581 from the separation position B to the reference position A.

Since the holder leading edge portion 581*a*1 of the shaft holder 581 in the reference position A is regulated by the access regulating portion 585*c*, the shaft holder 581 does not move in excess of the reference position A. Accordingly, between the supplying member 540 and the developing member 530 is formed a proper level of nip N.

The visible image of the developer T formed on the photosensitive body 300 is transferred on the printing medium P passing through the photosensitive body 300 and the transfer unit 600. The printing medium P on which an image is formed gets the transferred image fused by heat and pressure while it passes through the fusing unit 700.

As described above, the elastic unit 580 pressing the supplying member 540 in the direction to the developing member 530 is used so that the layer of the deposited and cured developer T in the fur brush 545 can easily pass through the most adjacent area S in an initial driving of the developing cartridge 500.

Here, the shaft holder 581 supporting the supplying member shaft 543 and the elastic member 583 elastically pressing the same are used to move and restore the supplying member 540. Also, the guide rail unit 585 is used to easily move the shaft holder 581, and the movement of the shaft holder 581 is regulated by the access regulating portion 585*c* and the separation regulating portion 585*d*.

As described above, the developing cartridge and the image forming apparatus having the developing cartridge according to the present general inventive concept has effects as follows. First, a layer of a deposited and cured developer in the fur brush enables a developing member and a supplying member to easily pass through in initially rotating a fur brush type supporting member, thereby preventing a misalignment phenomenon and a break-down of an apparatus.

Also, stress of the developer generated between the developing member and the supplying member are reduced to prevent a reversed polarity from being generated, thereby extending durability of the apparatus and preventing formation of various types of inferior image.

Further, by providing the above effects, a manufacturing and an upkeep cost can be reduced, and reliability of the product can be improved.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A developing cartridge usable with an image forming apparatus, the developing cartridge comprising:

a supporting frame;

a developing member to supply a developer to a photosensitive body of the image forming apparatus;

a supplying member to supply the developer to the developing member; and an elastic unit to elastically support the supplying member so that the supplying member can move toward and away from the developing member, wherein if a layer of the developer held on the supplying member reaches a thickness and the layer of the developer passes between the developing member and the supplying member, the supplying member moves away from the developing member against an elastic force of the elastic unit by the layer of the developer.

2. The developing cartridge according to claim 1, wherein the elastic unit directs the supplying member to move between a first position where the supplying member is adjacent to the developing member and a second position where the supplying member is spaced apart from the developing member.

3. The developing cartridge according to claim 2, wherein the elastic unit restores the supplying member to an original position if an external force is removed after the supplying member is separated from the developing member according to the external force applied to the supplying member.

4. The developing cartridge according to claim 1, wherein the elastic unit comprises:

a shaft holder to support the supplying member; and an elastic member to elastically press the shaft holder toward the developing member.

5. The developing cartridge according to claim 4, wherein the elastic unit further comprises:

a guide rail unit which is supported in the supporting frame and to guide movement of the shaft holder.

6. The developing cartridge according to claim 5, wherein the guide rail unit comprises:

a holder moving guide to guide the shaft holder to slide along with the supporting frame; and an elastic member accommodating portion which is formed in the supporting frame to be communicated with the holder moving guide, and to accommodate and support the elastic member so as to press the shaft holder.

7. The developing cartridge according to claim 6, wherein the guide rail unit comprises:

an access regulating portion which is provided in one end portion of the holder moving guide facing the developing member and to regulate the shaft holder to move in a direction pressing the elastic member; and a separation regulating portion which is provided in the other end portion of the holder moving guide opposite to the access regulating portion and regulates the movement of the shaft holder in an opposite direction with respect to the pressure direction of the elastic member.

8. The developing cartridge according to claim 1, wherein a distance D in which the supplying member can move by the elastic unit satisfies the following formula 1, $$0.4 \leqq D \leqq 0.6 \text{ [mm]}. \qquad \text{<formula 1>}$$

9. The developing cartridge according to claim 1, wherein the supplying member and the developing member rotate so that portions thereof facing each other can move in an opposite direction.

10. The developing cartridge according to claim 1, wherein the supplying member comprises:

a supplying member main body; and a fur brush which is provided along with a radial direction of the supplying member from a circumference of the supplying member main body.

11. The developing cartridge according to claim 10, wherein a thickness Ft and a length Fl of one texture of the fur brush satisfy the following formula 2, $$4 \leqq Ft \leqq 8 \text{ [denier]}$$

$$1.0 \leqq Fl \leqq 2.0 \text{ [mm]}. \qquad \text{<formula 2>}$$

12. The developing cartridge according to claim 10, wherein a nip N between the developing member and the supplying member satisfies the following formula 3, $$0.1 \leqq N \leqq 0.5 \text{ [mm]}. \qquad \text{<formula 3>}$$

13. An image forming apparatus, comprising:

a photosensitive body;

a laser scanning unit to scan a beam onto the photosensitive body and to form an electrostatic latent image;

a developing cartridge to form a visible image by developer with respect to the electrostatic latent image formed on the photosensitive body and to transfer the image to a printing medium, the developing cartridge comprises:

a supporting frame;

a developing member to supply the developer to the photosensitive body;

a supplying member to supply the developer to the developing member; and an elastic unit to elastically support the supplying member so that the supplying member can move toward and away from the developing member, wherein if a layer of the developer held on the supplying member reaches a thickness and the layer of the developer passes between the developing member and the supplying member, the supplying member moves away from the developing member against the elastic force of the elastic unit by the layer of the developer; and a fusing unit to fuse the image of the developer transferred to the printing medium.

14. The image forming apparatus according to claim 13, wherein the supplying member comprises:

a supplying member main body; and a fur brush which is provided along in a radial direction of the supplying member from a circumference of the supplying member main body.

15. The image forming apparatus according to claim 13, wherein a thickness Ft and a length Fl of one texture of the fur brush satisfy the following formula 4, $$4 \leqq Ft \leqq 8 \text{ [denier]}$$

$$1.0 \leqq Fl \leqq 2.0 \text{ [mm]}. \quad \text{<formula 4>}$$

16. The image forming apparatus according to claim 13, wherein a nip N between the developing member and the supplying member satisfies a following formula 5, $$0.1 \leqq N \leqq 0.5 \text{ [mm]}. \quad \text{<formula 5>}$$

17. A developing cartridge usable with an image forming apparatus, the developing cartridge comprising:

a supporting frame;

a developing member which is supported in the supporting frame, and to supply a developer to an electrostatic latent image of a photosensitive body of the image forming apparatus;

a supplying member which is supported in the supporting frame, and to supply the developer to the developing member;

wherein the supplying member moves between a reference position adjacent to the developing member and a separation position separated from the developing member, and if a layer of the developer held on the supplying member reaches a thickness and the layer of the developer passes between the developing member and the supplying member, the supplying member moves to the separation position by the layer of the developer.

18. The developing cartridge according to claim 17, wherein the supplying member comprises:

a supplying member main body; and a fur brush which is provided along in a radial direction of the supplying member from a circumference of the supplying member main body.

19. The developing cartridge according to claim 17, further comprising:

an elastic unit which is provided in the supporting frame, and to elastically support the supplying member so that the supplying member can move toward and away from the developing member.

20. A developing cartridge usable with an image forming apparatus, the developing cartridge comprising:

a developing member to supply developer to a photosensitive body of the image forming apparatus; and a supplying member to supply the developer to the developing member and to move to form a nip with the developing member, wherein the nip is regulated by changing a distance between the supplying member and the developing member, and if a layer of the developer held on the supplying member reaches a thickness and the layer of the developer passes between the developing member and the supplying member, the supplying member moves to the separation position by the layer of the developer.

21. The developing cartridge of claim 20, wherein the nip is regulated by an elastic unit to move the supplying member toward and away from the developing member.

22. The developing cartridge of claim 21, wherein the elastic unit directs the supplying member closest to the developing member in a normal state and at least a portion of the elastic unit is moved with the supply member away from the developing member in a stress-induced state.

* * * * *